US008151499B2

(12) United States Patent
Waas et al.

(10) Patent No.: US 8,151,499 B2
(45) Date of Patent: Apr. 10, 2012

(54) APPARATUS AND METHOD FOR DISPLAYING AN INFORMATIONAL CARRIER

(75) Inventors: Johannes Marinus Waas, Tolhuis (NL); Engelardus Wilhelmus Maria Broekman, Nijmegen (NL)

(73) Assignee: B & W Holding B.V., TJ Nijmegen (NL)

( * ) Notice: Subject to any disclaimer, the term of this patent is extended or adjusted under 35 U.S.C. 154(b) by 389 days.

(21) Appl. No.: 12/306,253

(22) PCT Filed: Jun. 19, 2007

(86) PCT No.: PCT/NL2007/000153

§ 371 (c)(1),
(2), (4) Date: Mar. 26, 2009

(87) PCT Pub. No.: WO2007/148962

PCT Pub. Date: Dec. 27, 2007

(65) Prior Publication Data

US 2009/0235565 A1 Sep. 24, 2009

(30) Foreign Application Priority Data

Jun. 20, 2006 (NL) ..... 1032029
Nov. 30, 2006 (NL) ..... 1032969

(51) Int. Cl.
*G09F 11/02* (2006.01)

(52) U.S. Cl. ..... 40/493; 40/601; 40/607.03; 40/607.1; 40/430

(58) Field of Classification Search ..... 40/493, 40/601, 607.03, 607.1, 430, 431, 473
See application file for complete search history.

(56) References Cited

U.S. PATENT DOCUMENTS

| | | | | |
|---|---|---|---|---|
| 1,869,003 | A * | 7/1932 | Ashley | 40/473 |
| 3,313,165 | A * | 4/1967 | Evans | 476/28 |
| 3,320,691 | A * | 5/1967 | Harmon | 40/473 |
| 3,579,880 | A * | 5/1971 | Murphy | 40/473 |
| 3,660,917 | A * | 5/1972 | Bevan | 40/473 |
| 3,875,691 | A * | 4/1975 | Patterson | 40/473 |
| 3,893,251 | A * | 7/1975 | Coleman | 40/572 |
| 3,947,985 | A * | 4/1976 | Skrzypczak | 40/473 |
| 4,662,096 | A * | 5/1987 | Bayless et al. | 40/607.03 |
| 4,937,499 | A * | 6/1990 | Hunte | 315/149 |
| 5,054,219 | A * | 10/1991 | Hoyt et al. | 40/473 |
| 6,148,552 | A * | 11/2000 | Dumontier et al. | 40/473 |
| 6,269,570 | B1 * | 8/2001 | Miles | 40/607.03 |
| 2004/0194361 | A1 * | 10/2004 | Furlan et al. | 40/601 |
| 2005/0235537 | A1 * | 10/2005 | Lee et al. | 40/607.03 |

FOREIGN PATENT DOCUMENTS

| | | | |
|---|---|---|---|
| DE | 203 20 331 | U1 | 5/2004 |
| DE | 10 2004 051587 | A1 | 5/2006 |

* cited by examiner

*Primary Examiner* — Gary Hoge
(74) *Attorney, Agent, or Firm* — Morgan, Lewis & Bockius LLP

(57) ABSTRACT

The present invention relates to an apparatus for displaying an information carrier to passers-by in the vicinity, in particular a carrier on which advertising information is visible, comprising: —a stationary support; —an elongate post arranged on the support; —a carrier which is to be provided with the information to be displayed; —translating means for translating the information carrier reciprocally in longitudinal direction along the post; —rotating means for rotating the information carrier relative to the stationary support.

46 Claims, 10 Drawing Sheets

APPARATUS AND METHOD FOR DISPLAYING AN INFORMATIONAL CARRIER

The present invention relates to an apparatus and method for displaying an information carrier to passers-by in the vicinity, in particular a carrier on which advertising is visible.

Many possibilities are already available for visualizing advertising messages. Known for instance is a vertically placed mast which is provided at the upper outer end with a revolving advertising sign. The revolving movement ensures that a random passer-by will readily notice the advertising message on the advertising sign.

A drawback of the known apparatus is that the movement of the advertising sign is readily predictable for a passer-by such that the attention of the passer-by is hardly attracted any more.

It is an object of the present invention to provide an apparatus and method which increase the attention of the vicinity for the information on the information carrier.

According to a first aspect of the present invention, this object is achieved in an apparatus for displaying an information carrier to passers-by in the vicinity, in particular a carrier on which advertising information is visible, comprising:

- a stationary support;
- an elongate post arranged on the support;
- a carrier which is to be provided with the information to be displayed;
- translating means for translating the information carrier reciprocally in longitudinal direction along the post;
- rotating means for rotating the information carrier relative to the stationary support.

By causing the carrier to not only rotate but also displace along the length of the post a less predictable movement of the carrier can be realized. A random observer will hereby be more likely to view the information (advertising) on the information carrier and to assimilate it. The translating means and rotating means are preferably adapted here to translate and rotate the carrier simultaneously. The translation and/or rotation can take place at varying speeds, can be temporarily interrupted and so on, always with the object of gaining the maximum attention of the passer-by. It has been found that attention is drawn particularly when the rotating and translating means are embodied for uninterrupted rotation of the carrier during the transition between a translating movement back and forth of the carrier. Because the carrier continues to turn as it moves reciprocally, a conspicuously smooth overall movement of the carrier is brought about.

In a determined preferred embodiment the post is arranged in stationary manner on the support and the rotating means are adapted to rotate the information carrier relative to the post. In another preferred embodiment the post is arranged rotatably on the stationary support and the rotating means are adapted to rotate the post and the information carrier arranged thereon.

In a further preferred embodiment the rotating means and translating means are connected to a control unit which is adapted to control the rotating and translating movements of the carrier. The control unit will usually comprise a programmable microcontroller and the associated electronic components. The translation and/or rotation movement of the carrier is hereby freely adjustable and can be modified in simple manner by the control unit.

In a further preferred embodiment the carrier comprises a number of transparent information elements provided with said information, wherein one or more lighting elements are arranged in the carrier for the purpose of illuminating the transparent information elements. This increases the visibility of the information on the carrier. The frame of the carrier is preferably embodied such that information-carrying, transparent elements such as posters and the like are displaceable. This means that no measures have to be taken on the apparatus itself in order to enable arrangement of the advertising and changing thereof.

According to a further preferred embodiment, the rotating means and/or the translating means are arranged in the carrier itself, which enables a relatively simple and light construction. In a determined preferred embodiment the translating means comprise a number of first wheels arranged between the carriage and the post and extending substantially in longitudinal direction of the post, and a drive with which one or more of the first wheels, which is or are preferably held under spring tension against the post during use, can be driven. The spring tension prevents slippage of the wheels along the post.

As alternative to the use of resilient elements or in addition to the use thereof, the peripheral surface of the driven first wheel or the driven first wheels can be provided with first teeth and the post can be provided with second teeth which extend in transverse direction and which during use engage on the first teeth. The teeth ensure that the wheels cannot slip relative to the post.

In another preferred embodiment the translating means comprise a number of first wheels arranged between the carriage and the post and extending substantially in longitudinal direction of the post, and a lifting mechanism with which the carriage can be moved up and downward. Instead of being displaced with driven wheels, the carrier in this embodiment is raised and lowered by an external lifting mechanism. In an advantageous embodiment the lifting mechanism herein comprises a winch which is provided in or close to the foot of the post and on which a cable running via a roller mounted in or close to the top of the post can be wound and unwound so as to cause the carriage to be moved respectively upward and downward. In order to reduce the forces acting on the winch, a counterweight engaging on the carrier is often applied in this embodiment.

In a further preferred embodiment the rotating means comprise second wheels arranged between the frame and the carriage of the carrier; and a drive with which one or more of the second wheels can be driven, wherein the second wheels are arranged to cause rotation of the frame when they are driven. Not only the translation but also the rotation of the carrier is brought about by applying a number of wheels to be arranged against the post, whereby the post acquires an attractive and smooth appearance.

The first wheels and/or the second wheels are preferably distributed uniformly over the peripheral surface of the post. This means that the post remains clamped between the wheels in the correct manner.

The post is preferably provided with an elongate passage extending in longitudinal direction, whereby the power supply to the drive of the carrier and the optional lighting in the carrier can take place via the interior of the post.

A further preferred embodiment comprises a light intensity meter with which the momentary or average intensity of the ambient light can be determined, wherein the light intensity meter is connected to the control means for switching the lighting elements on and off subject to the determined light intensity. It is also possible to increase or decrease the lighting intensity generated by the lighting elements subject to the determined light intensity. In order to prevent incorrect switching on and off, dimming and the like in the case of brief ambient light, such as that caused by lightning or by car lamps, the control means determine the average light intensity over a predetermined period of time, switch the lighting on and/or off and/or increase or decrease the emitted light intensity subject to the thus average light intensity.

Another preferred embodiment comprises a wind meter with which the speed of wind flowing along the apparatus can be determined, wherein the wind meter is connected to the control means for controlling the rotating and/or translating movement of the carrier subject to the determined wind speed. At too great a wind strength the construction could otherwise be damaged.

According to another aspect of the present invention, there is provided a method for displaying an information carrier to passers-by in the vicinity, in particular a carrier on which advertising formation is visible, comprising of translating along an elongate post and rotating around the post a carrier which is to be provided with the information to be displayed.

Further advantages, features and details of the present invention will be elucidated on the basis of the following description of several preferred embodiments thereof. Reference is made in the description to the accompanying figures, in which.

Figure 1:
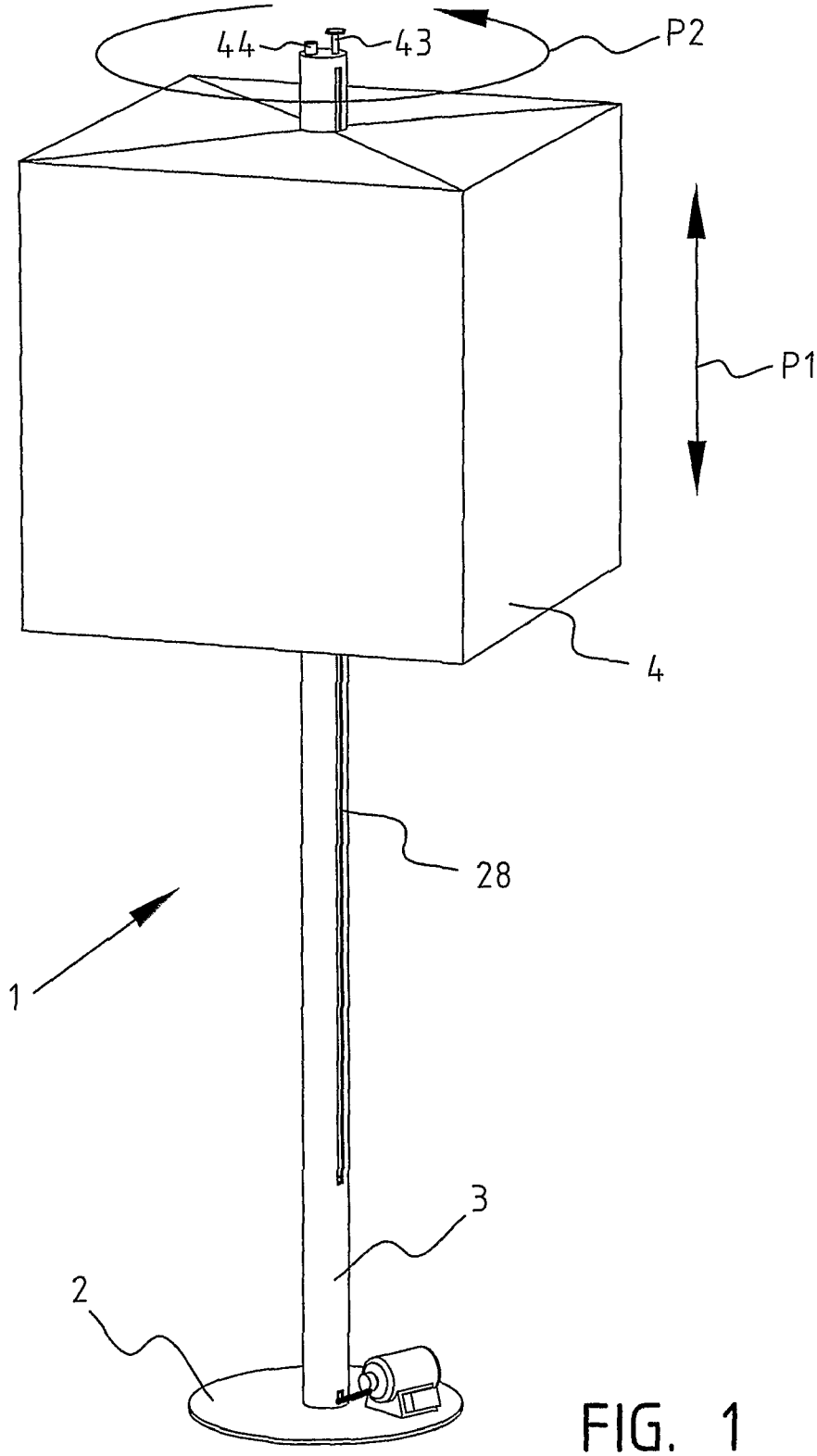
FIG. 1 shows a perspective view of a preferred embodiment of the advertising pillar.

FIG. 1 shows an advertising pillar 1 which is constructed from a mast foot 2 on which is arranged an aluminium mast 3 which is about 3 m high. A cube-shaped carrier 4 is displaceable in vertical direction (arrow $P_1$) along the mast and displaceable in rotating direction (arrow $P_2$) around mast 3. In the shown embodiment the carrier 4 has the shape of a cube, the four side surfaces of which can be provided with information, such as advertising messages, information messages and the like. Instead of a cube shape, carrier 4 can also have another form at random, such as for instance a cylinder shape. Carrier 4 extends substantially symmetrically relative to the post. In the shown embodiment this means that the post is arranged practically in the centre of the cube. This improves the stability of advertising pillar 1.

Figure 2:
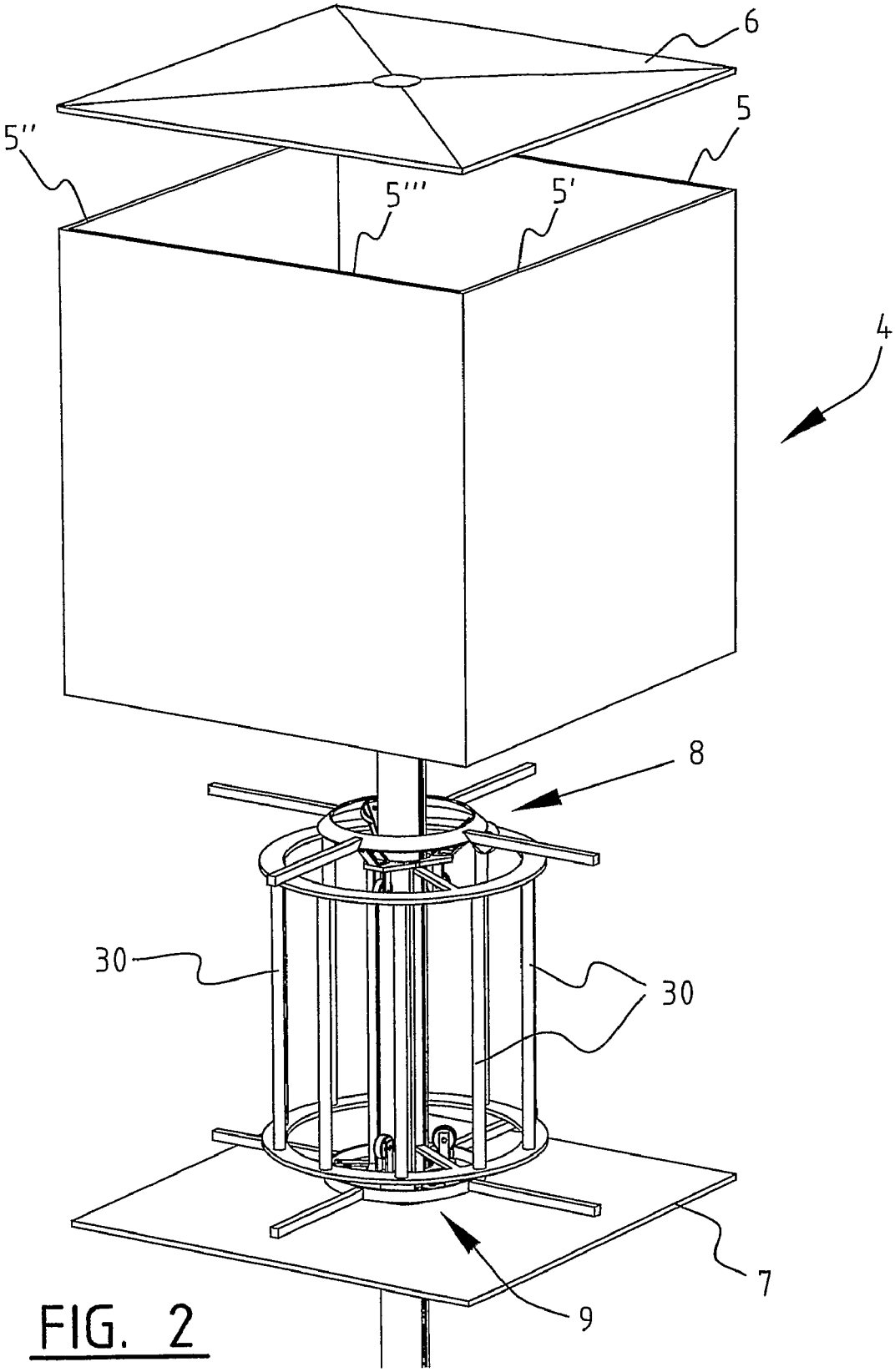
FIG. 2 shows a partially exploded perspective view of the advertising carrier.
Figure 3:
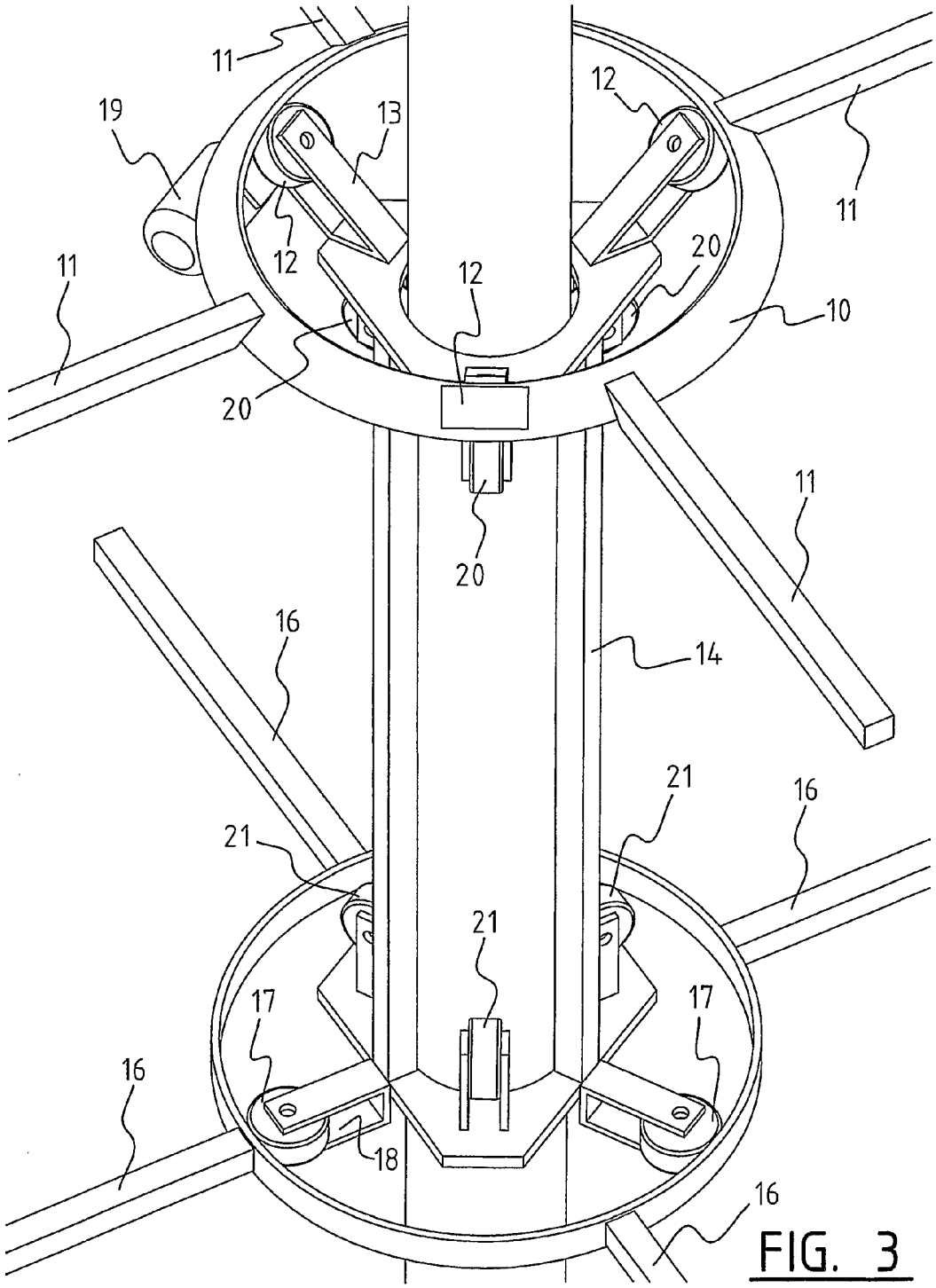
FIG. 3 shows a further cut-away perspective view of a preferred embodiment of the advertising pillar.

FIG. 2 shows in further detail a preferred embodiment of carrier 4. The carrier comprises four walls 5, 5', 5", 5''' which are manufactured at least partially from transparent material. The walls are fixed to respectively a top cover 6 and a bottom cover 7. Top cover 6 rests on an upper frame part 8, while bottom cover 7 is fixed to a lower frame part 9. In the shown embodiment the upper frame part 8 (FIG. 3) comprises an annular element 10 which is positioned at an angle relative to the vertical direction and from which extend four radially extending rods 11. These rods 11 function as support for top cover 6. The upper frame part 8, or at least the annular part 10 thereof, rests on three wheels 12 which are mounted rotatably in respective supports 13, which are in turn fixed to a carriage 14 displaceable in longitudinal direction along mast 3.

Lower frame part 9 is constructed from a vertically extending annular element 15 from which four rods 16 extend. Rods 16 serve to fix the bottom cover 7 of the cube. The annular element 15 is arranged rotatably between three wheels 17 which are mounted on horizontal supports 18. Supports 18 are in turn fixed to the above mentioned carriage 14.

An intermediate frame part is provided between upper frame part 8 and lower frame part 9. The intermediate frame part couples upper frame part 8 to lower frame part 9. Light fittings 30 which provide for the necessary illumination of walls 5 of carrier 4 are attached to the intermediate frame part. In the shown embodiment the lighting is formed by twelve vertically extending fluorescent lamps (30 W) placed in a circle (diameter about 70 cm). The lighting is therefore fixedly mounted on carriage 14 and so does not co-rotate with the cube.

Owing to the described construction carrier 4 is rotatable relative to mast 3, or at least relative to carriage 14. The rotation movement can be driven by driving one or more of the wheels 12 and/or one or more of the wheels 17. In the shown embodiment one of the wheels 12 is driven, this by means of an electric motor 19.

The translating movement of carrier 4 is brought about by a number of wheels mounted on carriage 14. For this purpose three wheels 20 are provided on the top side of the carriage and three wheels 21 on the bottom side of the carriage. One or more of the wheels 20 and/or one or more of the wheels 21 can herein be driven, as will be described hereinbelow. In the embodiment shown in FIG. 3 the vertical translating movement is however driven by an indirect drive using a winch 22 arranged on or close to the mast foot.

Figure 4:
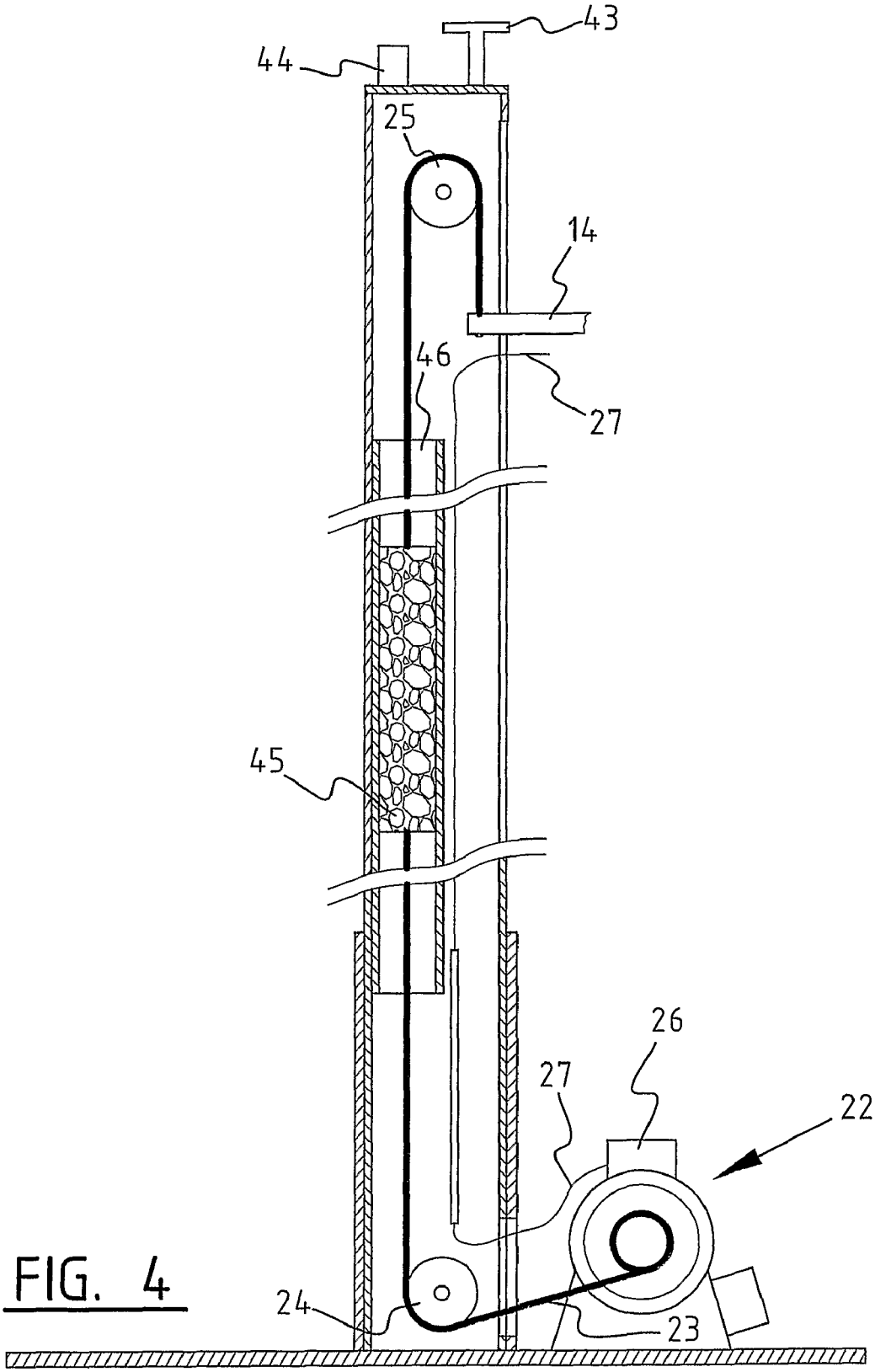
FIG. 4 shows a cross-section through the advertising pillar in the case of the indirect or winch driving.

Such a drive is further elucidated in FIG. 4. Clearly shown is an electrically driven winch 22 on which is wound a cable 23. Cable 23 is guided to carrier 4, and more specifically carriage 14, via a roll 24 arranged at the bottom of mast 3 and a roll 25 arranged at the top of the mast. Arranged in mast 3 is a PVC pipe 46 along which a counterweight 45 (for instance of concrete) is displaceable in vertical direction. Counterweight 45 is attached to cable 23 and has a mass which is slightly smaller than the mass of carrier 4. The counterweight has the function of reducing the forces exerted on winch 22.

By rotating the winch to the left in the shown embodiment, carriage 14 and the advertising material attached thereto will move upward, while in the case of a rotation to the right carriage 14 and the advertising material is displaced downward.

The speed and timing of the vertical displacement, and thereby the speed and timing of winch 22, can be controlled using a central processing unit 26. This processing unit is likewise connected using wiring 27 to the above mentioned motor 19 with which the rotating movement is effected. Mast 3 is provided for this purpose with a vertical recess 28. Recess 28 functions as throughfeed for wiring 27. Wiring 27 is otherwise intended not only for power supply to motor 19 but also for power supply to the light fittings 30 of carrier 4.

Figure 5:
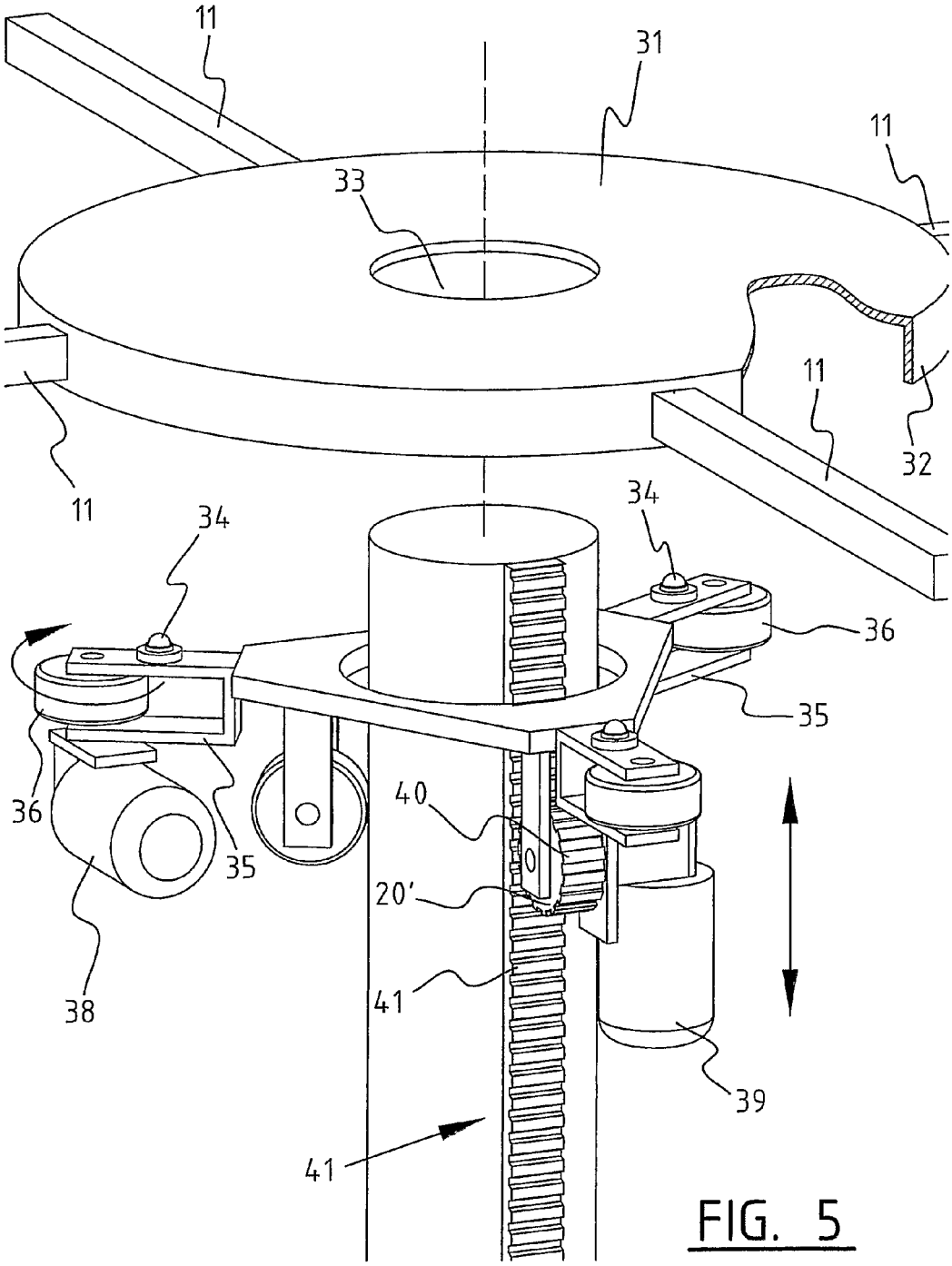
FIG. 5 is an exploded perspective view of a further preferred embodiment of the advertising pillar with a direct driving.
Figure 6:
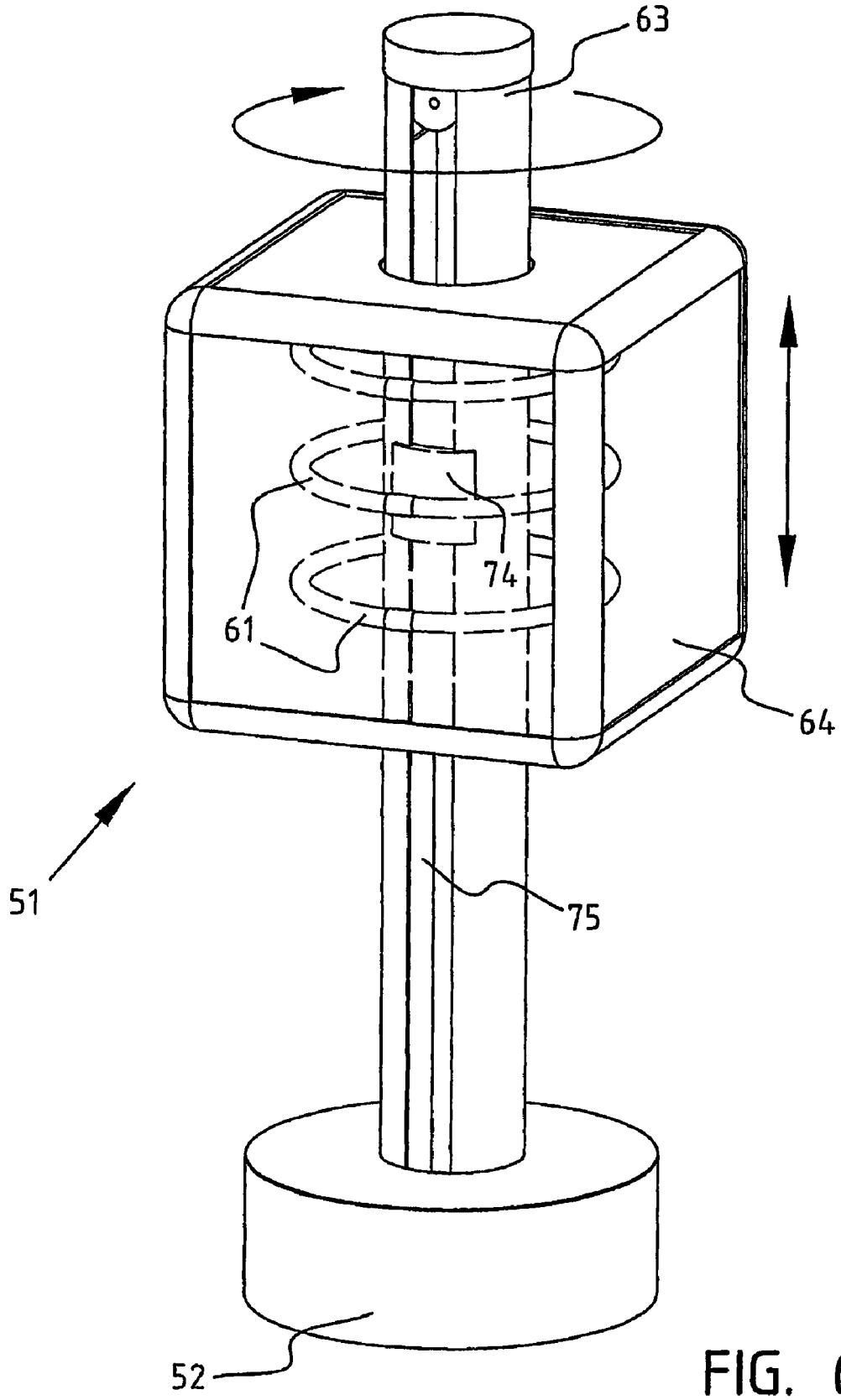
FIG. 6 shows a schematic perspective view of a further preferred embodiment of the invention.
Figure 7:
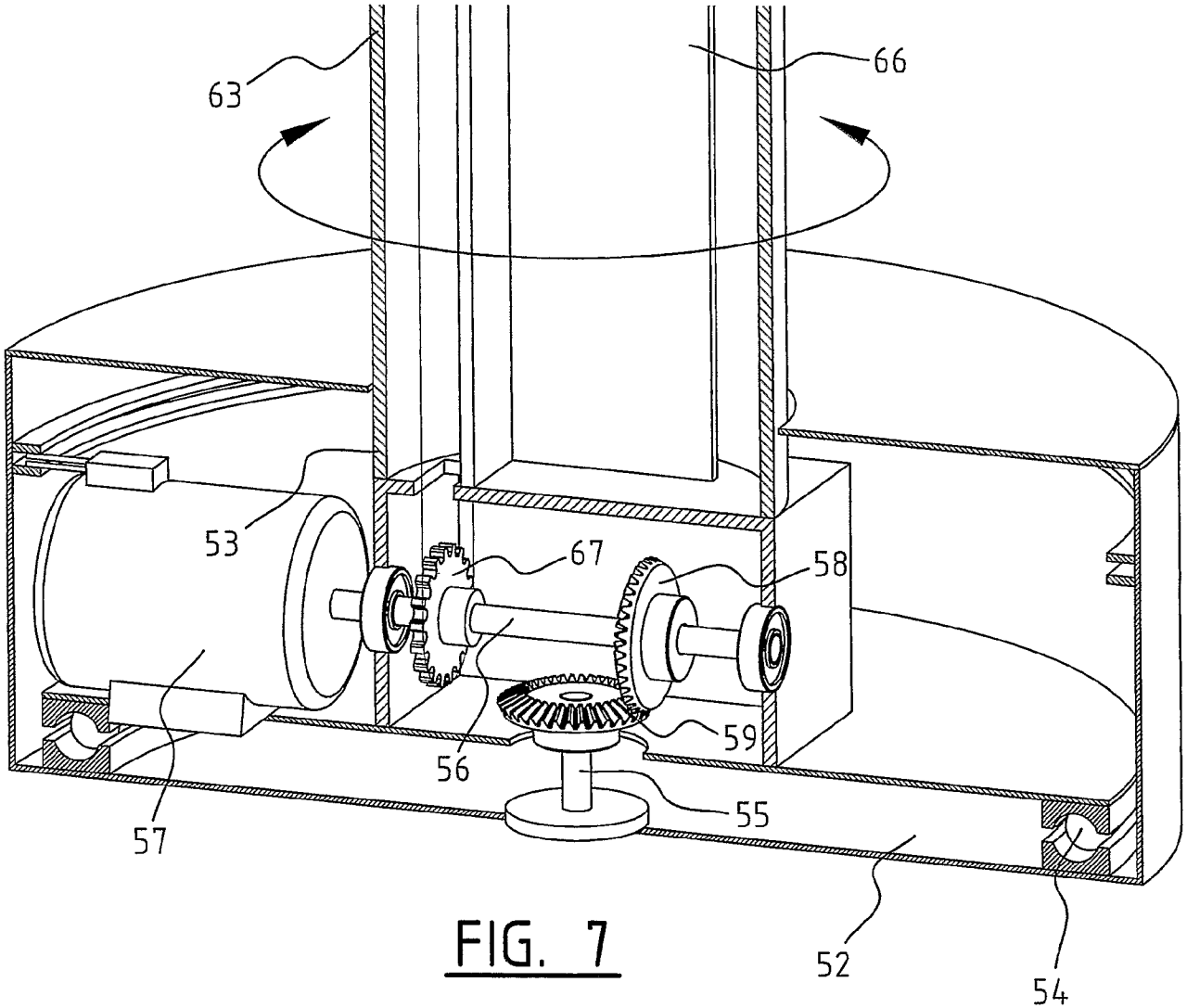
FIG. 7 is a cross-section through the lower part of the preferred embodiment shown in FIG. 6.
Figure 8:
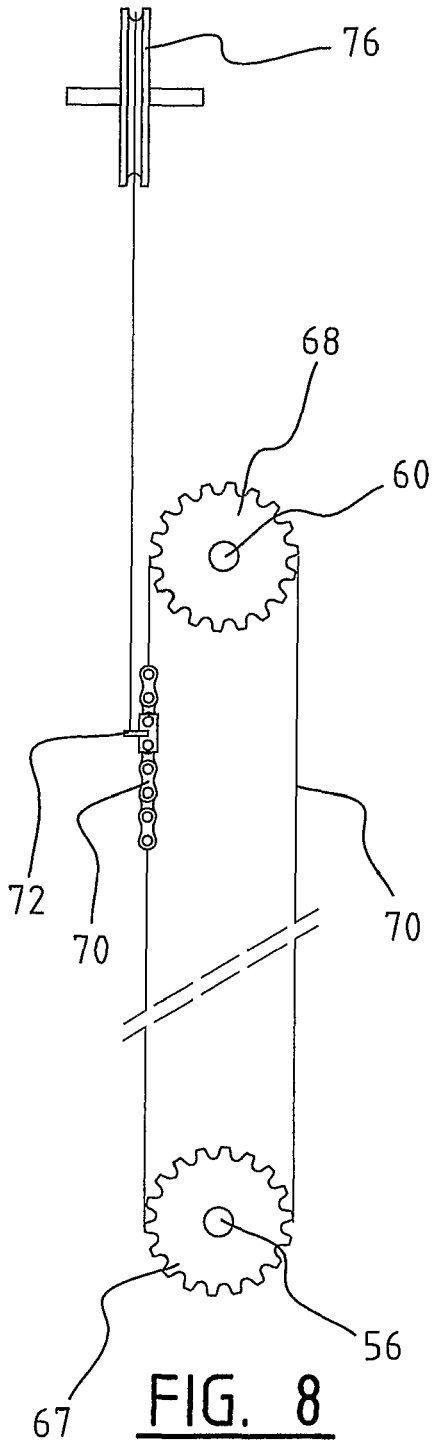
FIG. 8 is a schematic view of the chain drive of the carriage.
Figure 9:
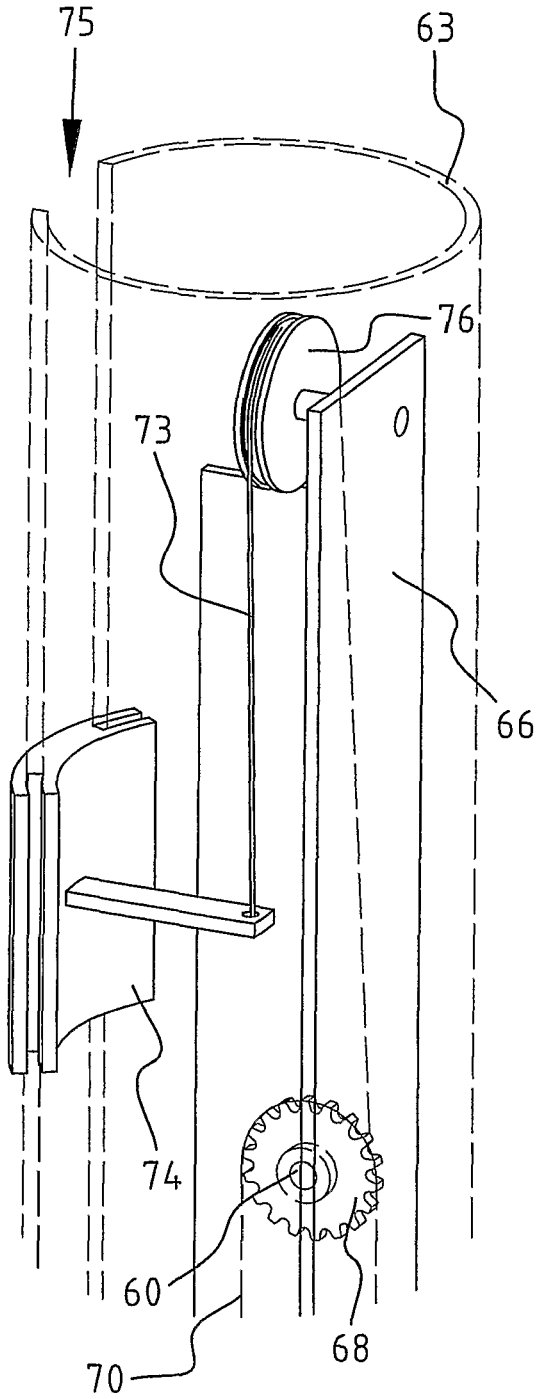
FIG. 9 is a partially cut-away schematic view of the upper part of the preferred embodiment shown in FIG. 6.

FIG. 5 shows an alternative embodiment of the rotating movement and the translating movement of carrier 4.

Instead of the annular upper element 10 lying at an angle, the upper frame part is provided in this embodiment with a horizontal disc 31 which is provided on its peripheral edge with a downward hanging flange 32. Four radially extending rods 11 are again fixed to flange 32. Disc 31 and the rods 11 fixed thereto function as support for top cover 6. Disc 31 is provided with a central opening 33 with a diameter slightly larger than that of mast 3. Disc 31 can be rotatably mounted on carriage 14 by being placed on three spherical bearings 34 which are mounted on respective horizontal supports 35. Also arranged in supports 35 are horizontal wheels 36 which in the assembled state rest against the inner side of flange 32. Due to the combination of spherical bearings 34 and wheels 36 the disc 31 can rotate around mast 3 with minimal friction. The rotation movement is driven by one or more motors 38 which drive one or more of wheels 36.

The translating movement is realized in this embodiment by driving one or more of wheels 21 or one or more of wheels 20 using an electric motor 39. In the shown embodiment motor 39 drives a wheel which is embodied as pinion 20', i.e. the peripheral surface of the wheel is provided with a number of teeth 40. Teeth 40 engage in corresponding teeth 41 of a gear rack 42 arranged vertically on mast 3. The use of a pinion with rack prevents the wheel 20 slipping along the outer side of the mast and thereby adversely affecting the vertical movement of carrier 4.

In yet another preferred embodiment however, a wheel 20 provided with a rubber running surface is applied, which is pressed under spring tension against the peripheral surface of mast 3. At a sufficient spring tension the carriage 14 is clamped against the mast to sufficient extent and the danger of wheel slippage along the mast is minimal. In this embodiment the rack-pinion combination can therefore be omitted. This has the additional advantage that the peripheral surface of the mast can remain smooth, which gives the mast a more attractive appearance.

Owing to the described independent embodiment of the rotating movement and the translating movement of the carrier, both movements can be performed in random manner relative to each other. The movements can be adjusted as desired using processing unit 26. In a specific setting of the processing unit the carrier moves slowly up and downward (maximum translation speed of about 10 meters per minute), while the carrier continues to rotate slowly in one direction (maximum rotation speed of about 0.1 revolution per second). While the translating movement (arrow $P_1$) is interrupted each time the carrier arrives at the top side or the bottom side of the mast, processing unit 26 can be set such that the rotating movement (arrow $P_2$) continues. It is however likewise possible to reverse the rotation direction of the carrier, for instance when the carrier arrives at the top side or the bottom side of mast 3. It is further possible to vary the rotation and/or translation speeds as desired. An unpredictable or attractive pattern of movement of the carrier can hereby be generated such that the advertising pillar draws the maximum attention of the observer.

In a further preferred embodiment the advertising pillar 1 is provided with a wind meter 43 with which the speed of the wind can be measured. This wind meter 43 is connected to processing unit 26. Processing unit 26 can for instance be set such that at a wind force greater than force 5 the carrier 4 is displaced downward to its lowest position and remains there for a predetermined period of time (for instance an hour). The drive motors are then switched off and only switched on again when at least the preset time period has elapsed and a wind force greater than force 5 has not been measured during this time.

In a further preferred embodiment a light cell 44 is mounted with which the ambient light can be measured. Light cell 44 is once again connected to processing unit 26 which is set to switch on the lighting as soon as dusk falls and to switch off the lighting as soon as it becomes light again. In the further preferred embodiment the processing unit or the light cell is provided with a time delay so as to prevent the lighting being switched off in the case of a brief increase in light, for instance as a result of lightning or as a result of car lamps.

In the shown preferred embodiment the mast is arranged vertically on a mast foot 2 and carrier 4 turns in the horizontal plane. In other embodiments (not shown) mast 3 hangs downward, for instance by fixing mast 3 to the ceiling or roof of a petrol station. In this case the carrier also turns in a horizontal plane. In other preferred embodiments however, the mast is placed obliquely or the mast is attached to a vertical wall. In such a case the carrier therefore rotates in a plane extending obliquely relative to the ground or in the vertical plane.

FIGS. 6-9 show a further embodiment of the invention. In this embodiment the post itself is embodied for rotation relative to the ground surface and the carrier performs only a translating (in the case of a vertically disposed post an upward and downward) movement relative to the ground surface, as will be set forth below. Shown is an advertising pillar 51 provided with a stationary support 52 which can be placed on the ground surface. Support 52 is fixed in known manner to the ground surface, for instance by being anchored in the ground surface. A post part 53 is mounted on support 52. Post part 53 is embodied for rotation relative to support 52. In the shown embodiment a mechanism with bearings 54 is provided for this purpose between post part 53 and the support 52 and mast foot 52, so that post part 53 is rotatable relative to stationary support 54 around a vertical shaft 55 mounted fixedly on stationary support 54. An electric drive motor 57 is further placed in the rotatable post part 53. Motor shaft 56 of drive motor 57 is provided with a toothed wheel 58 which can engage on a corresponding toothed wheel 59 mounted fixedly on stationary shaft 55.

A chain wheel 67 is also arranged on stationary shaft 56. Via an endless chain 70 chain wheel 67 is coupled to a second chain wheel 68. The second chain wheel 68 is arranged on a rotation shaft 60 which is in turn mounted rotatably in a post part 66 fixed to post part 53 or forming part thereof. The rotatable post part 53 is also provided with a further tubular post part 63.

Owing to the shown construction the post built up of post parts 53,63 and 66 is rotatable around a vertical axis. When drive motor 57 is driven, the rotation of motor shaft 56 is transmitted to the post via rotating toothed wheel 58 and stationary toothed wheel 59 so that the entity of post parts 53,63,66 and the carrier 64 arranged thereon begins to rotate.

Carrier 64 can displace along the post in the above described manner or in similar manner, for instance in that it is provided with a wheelless carriage or slide plate 74. Slide plate 74 runs in a channel 75 present in tubular post part 63. The up and downward movement is driven in a manner to be further elucidated below by the above mentioned drive motor 57.

Drive motor 57 provides not only for rotation of the post but simultaneously sets chain wheels 67 and 68 into rotation. The revolving endless chain 70 brings about an up and downward movement of carrier 64 relative to the post. For this purpose chain 70 is provided with a protrusion 72, and between protrusion 72 and carrier 64, more specifically the slide plate or carriage 74 thereof, there is provided a connecting element 73, for instance a chord or chain, guided over a chain wheel or roller 76. When chain 70 is transported, protrusion 72 performs an up and downward movement which is transmitted via connecting element 73 onto information carrier 64. A rotating movement around a vertical rotation axis as well as a translating movement along the post is thus realized by making use of a single drive motor 57. It is therefore possible to suffice with a simple construction in which only one drive is necessary to bring about both displacements (i.e. the translation and rotation of the carrier).

In the shown embodiment use is made of one, two or three circular fluorescent lamps 61. Owing to the circular form of these lamps the desired uniform distribution of light can be realized with a relatively small number of lamps. The electrical control (ballast) of the lamps can be simplified due to the small number of lamps required.

In the embodiment shown in FIGS. 6-9 the size of the cube-shaped carrier 64 is about 400×300×300 cm. A different dimensioning in accordance with the wishes of the user is of course also an option.

In a further embodiment (not shown) the chain is replaced by an endless belt and the chain wheels are replaced by rollers. Arranged in this embodiment at the opposite end of the above mentioned rotation shaft 60 (FIG. 8) is a third roller, roughly at the position at which roller 76 was provided in the previous embodiment. Using a second endless belt the third roller is coupled to a fourth roller provided at the top of post part 66. In this embodiment it is the revolving second endless belt which brings about the up and downward movement of carrier 64 relative to the post. The second endless belt is provided for this purpose with a protrusion and a connecting element, for instance a chord or chain, is provided between the protrusion and carrier 64. When the second endless belt is transported, the protrusion performs an up and downward movement which is transmitted via connecting element 73 onto information carrier 64.

Figure 10:
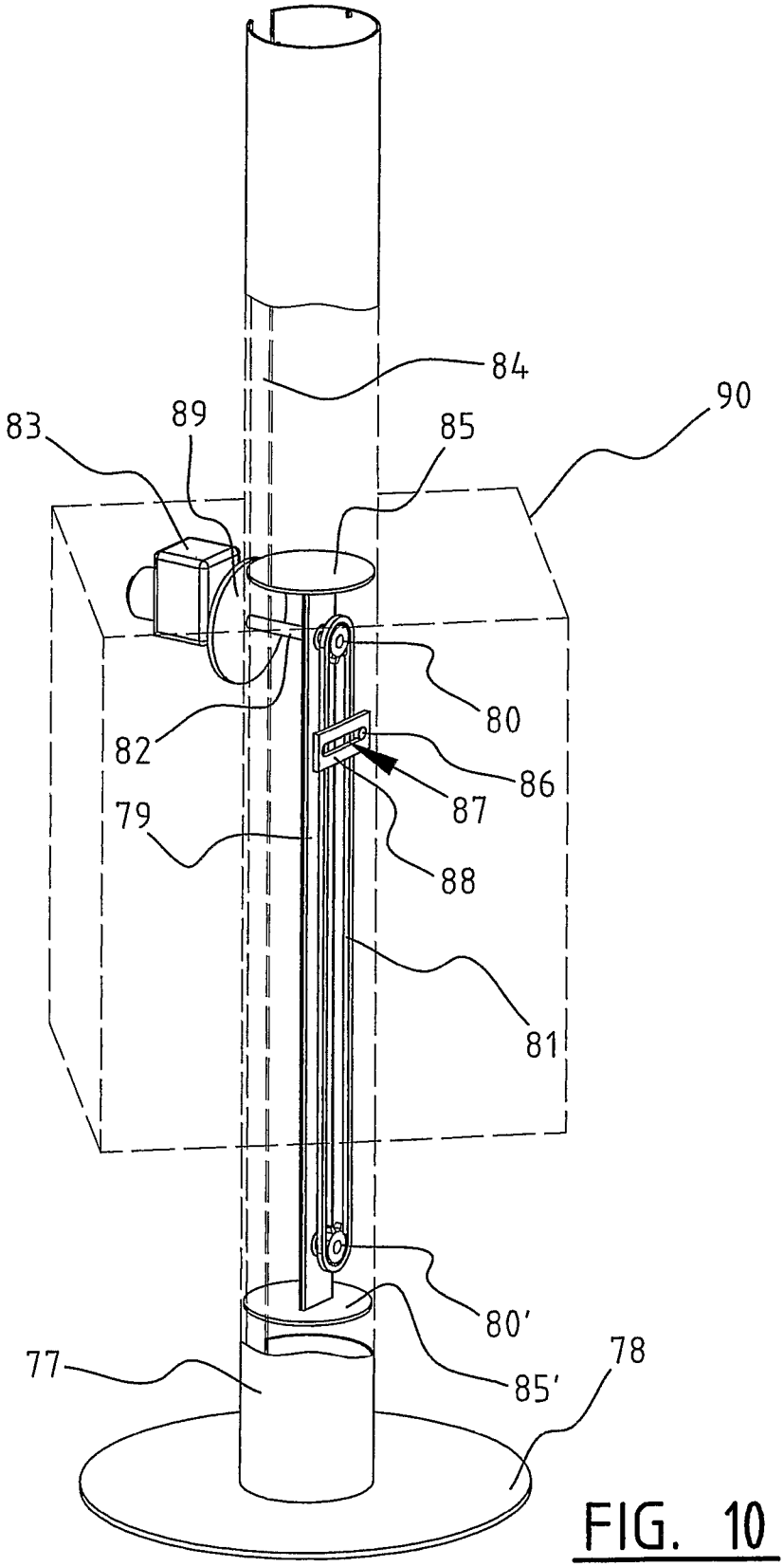
FIG. 10 is a schematic view of a further preferred embodiment of the invention.

FIG. 10 shows a further embodiment of the invention. In this embodiment a post 77 is fixed in stationary manner to a support 78. Accommodated inside the post is a carriage 79 comprising two wheels 80 and 80' which are mutually connected by means of a chain 81. One of the wheels is connected by means of a shaft 82 to an electric motor 83. This connection is possible in that an opening 84 is arranged in the post. This opening enables a vertical movement of the carriage. This movement is further supported by slide plates 85 and 85'.

Chain 81 is provided with a catch 86. This catch protrudes in the direction perpendicular to the translating direction. The catch protrudes through an opening 87 of a fixing plate 88 fixedly connected to the post. The opening is such that the catch can make a movement therein in the plane perpendicularly of the post. When driven by the motor, the chain will rotate round the wheels. Because the catch can only move perpendicularly of the translating direction, the carriage is pulled upward or downward in accordance with the position of the catch.

Shaft 82 preferably comprises a drive wheel 89 which rotates a frame 90 with the information thereon. Because the motor is connected to the carriage, the frame also performs a translating movement in addition to the rotating movement. In this manner a single electric motor can serve as drive for the rotating and translating movements. It is also possible to add light elements, not shown in the figure, to the carrier.

Figure 11:
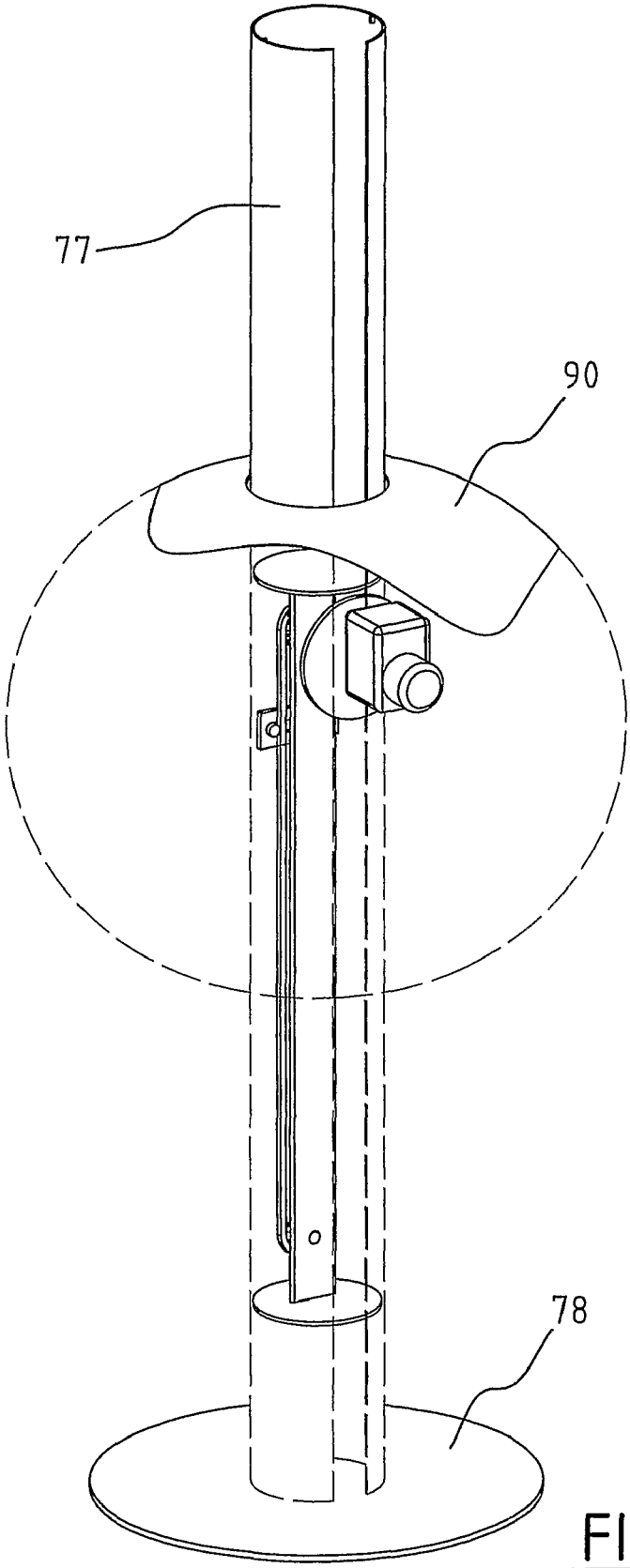
FIG. 11 shows a further preferred embodiment of the invention comprising a spherical carrier.

FIG. 11 shows an embodiment with a spherical carrier. Other forms of the carrier are not precluded by the description of the present invention.

In FIGS. 10-11, as well as in the other figures in this description, the explanation has been limited to several components of the device. Other components, such as for instance means for strengthening the construction of electric motor 83, shaft 82 and wheel 80, are not shown or discussed. These components, and the possible solutions for incorporating or arranging these components in an embodiment of the present invention, are subject-matter or techniques known to the skilled person, and therefore require no further elucidation.

The invention is not limited to the above described preferred embodiments thereof. The rights sought are defined by the following claims, within the scope of which many modifications can be envisaged.

The invention claimed is:

1. Apparatus for displaying an information carrier to passers-by in the vicinity, in particular a carrier on which advertising information is visible, comprising:

a stationary support;

an elongate post arranged on the support;

a carrier which is to be provided with the information to be displayed;

translating means for translating the information carrier reciprocally in longitudinal direction along the post;

rotating means for rotating the information carrier relative to the stationary support wherein the translating means and rotating means are adapted to translate and rotate the carrier simultaneously.

2. Apparatus as claimed in claim 1, wherein the post is arranged in stationary manner on the support and the rotating means are adapted to rotate the information carrier relative to the post.

3. Apparatus as claimed in claim 1, wherein the post is arranged rotatably on the stationary support and the rotating means are adapted to rotate the post and the information carrier arranged thereon.

4. Apparatus as claimed in claim 3, wherein the rotating means and translating means comprise a shared drive.

5. Apparatus as claimed in claim 4, wherein a drive comprises:

an electric motor mounted in or on the post;

a stationary shaft fixed to the support; and a transmission between a shaft of the electric motor and the stationary shaft.

6. Apparatus as claimed in claim 4, wherein the shared drive comprises a single electric motor.

7. Apparatus as claimed in claim 1, wherein the rotating means and translating means are connected to a control unit which is adapted to control the rotating and translating movements of the carrier.

8. Apparatus as claimed in claim 7, comprising a light intensity meter with which the momentary or average intensity of the ambient light can be determined, wherein the light intensity meter is connected to the control means for switching the lighting elements on and off subject to the determined light intensity.

9. Apparatus as claimed in claim 7, comprising a light intensity meter with which the momentary or average intensity of the ambient light can be determined, wherein the light intensity meter is connected to the control means for increasing or decreasing the lighting intensity emitted by the lighting elements subject to the determined light intensity.

10. Apparatus as claimed in claim 9, wherein the control means determine the average light intensity over a predetermined period of time, and switch the lighting on and/or off subject to the average light intensity.

11. Apparatus as claimed in claim 7, comprising a wind meter with which the speed of wind flowing along the apparatus can be determined, wherein the wind meter is connected to the control means for controlling the rotating and/or translating movement of the carrier subject to the determined wind speed.

12. Apparatus as claimed in claim 11, wherein the control means are set to determine whether the wind speed is greater than a predetermined limit value and, when the limit values are exceeded, to stop the rotating movement, translate the carrier into a safe position and stop the translating movement of the carrier.

13. Apparatus as claimed in claim 1, wherein the rotating and translating means are embodied for uninterrupted rotation of the carrier during the transition between a translating movement back and forth of the carrier.

14. Apparatus as claimed in claim 1, wherein the rotating means are arranged in the carrier.

15. Apparatus as claimed in claim 1, wherein the translating means are arranged in the carrier.

16. Apparatus as claimed in claim 1, wherein the carrier comprises a frame, which is to be provided with said information, and a carriage translatable along the post.

17. Apparatus as claimed in claim 16, wherein the frame is arranged rotatably on the carriage.

18. Apparatus as claimed in claim 16, wherein the translating means comprise:

a number of first wheels arranged between the carriage and the post and extending substantially in longitudinal direction of the post, a drive with which one or more of the first wheels can be driven.

19. Apparatus as claimed in claim 18, comprising one or more spring elements for holding the first wheels under spring tension against the post.

20. Apparatus as claimed in claim 18, wherein the drive comprises an electric motor mounted on the carriage.

21. Apparatus as claimed in claim 18, wherein the peripheral surface of one or more of the first wheels driven by said drive is provided with first teeth and the post is provided with second teeth which extend in transverse direction and which during use engage on the first teeth.

22. Apparatus as claimed in claim 18, wherein the rotating means comprise:

second wheels arranged between the frame and the carriage;

a drive with which one or more of the second wheels can be driven, wherein the second wheels are arranged to cause rotation of the frame when they are driven.

23. Apparatus as claimed in claim 22, wherein the second wheels extend during use substantially transversely of the longitudinal direction of the post.

24. Apparatus as claimed in claim 22, wherein the frame comprises a disc-like part with flange, and the second wheels are disposed for the purpose of engaging on the inner side of the flange.

25. Apparatus as claimed in claim 24, also comprising rotating support elements, which are arranged on the carriage and over which the disc-like part can rotate.

26. Apparatus as claimed in claim 25, wherein the rotating support elements are roller bearings.

27. Apparatus as claimed in claim 22, wherein the frame comprises an annular element and the second wheels are disposed for the purpose of engaging on the inner side of the annular element.

28. Apparatus as claimed in claim 27, wherein the second wheels and the annular element are disposed obliquely, at an angle of about 45° relative to the longitudinal direction of the post.

29. Apparatus as claimed in claim 22, wherein the number of second wheels equals three, and the second wheels are arranged in substantially uniform distribution over the peripheral surface of the post.

30. Apparatus as claimed in claim 18, wherein the number of first wheels equals three, and the first wheels are arranged in substantially uniform distribution over the peripheral surface of the post.

31. Apparatus as claimed in claim 16, wherein the translating means comprise;

a number of first wheels arranged between the carriage and the post and extending substantially in longitudinal direction of the post, a lifting mechanism with which the carriage can be moved up and downward.

32. Apparatus as claimed in claim 31, wherein the lifting mechanism comprises a winch which is provided in or close to the foot of the post and on which a cable running via a roller mounted in or close to the top of the post can be wound and unwound so as to cause the carriage to be moved respectively upward and downward.

33. Apparatus as claimed in claim 32, wherein the lifting mechanism comprises a counterweight.

34. Apparatus as claimed in claim 16, wherein the carrier comprises one or more lighting elements fixed to the carriage of the carrier.

35. Apparatus as claimed in claim 1, wherein the post is provided with an elongate passage extending in longitudinal direction.

36. Apparatus as claimed in claim 1, wherein the post extends substantially upward or downward during use.

37. Apparatus as claimed in claim 1, wherein the post can be fixed to an upright wall and extends substantially laterally.

38. Apparatus as claimed in claim 1, wherein the rotation speed of the carrier is adjustable between 0 and 6 revolutions per minute.

39. Apparatus as claimed in claim 1, wherein the translation speed of the carrier is adjustable between 0 and 10 meters per minute.

40. Apparatus as claimed in claim 1, wherein the carrier extends substantially symmetrically relative to the post.

41. Method for displaying an information carrier to passers-by in the vicinity, in particular a carrier on which advertising formation is visible, comprising translating along an elongate post and rotating around the post a carrier which is to be provided with the information to be displayed, wherein said translating and rotating of the carrier respectively along and around said post is simultaneous.

42. Method as claimed in claim 41, comprising of uninterrupted rotation of the carrier during the transition between a translating movement back and forth of the carrier.

43. Method as claimed in claim 41, comprising of determining the momentary or average intensity of the ambient light and switching on and off lighting arranged in the carrier subject to the determined light intensity.

44. Method as claimed in claim 41, comprising of determining the momentary or average intensity of the ambient light and increasing or decreasing the lighting intensity emitted by lighting arranged in the carrier subject to the determined light intensity.

45. Method as claimed claim 41, comprising of determining the speed of wind flowing along the post and controlling the rotating and/or translating movement of the carrier subject to the determined wind speed.

46. Method as claimed in claim 45, comprising of determining whether the wind speed is greater than a predetermined limit value and, when the limit value is exceeded, stopping the rotation, translating the carrier into a safe position and stopping the translation of the carrier.

* * * * *